US010798793B2

(12) United States Patent
Sugawara

(10) Patent No.: US 10,798,793 B2
(45) Date of Patent: Oct. 6, 2020

(54) STROBE DEVICE CAPABLE OF EMITTING ASSIST CONTINUOUS LIGHT, AND METHOD OF CONTROLLING SAME

(71) Applicant: CANON KABUSHIKI KAISHA, Tokyo (JP)

(72) Inventor: Azusa Sugawara, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/699,214

(22) Filed: Nov. 29, 2019

(65) Prior Publication Data

US 2020/0178366 A1 Jun. 4, 2020

(30) Foreign Application Priority Data

Dec. 4, 2018 (JP) ..... 2018-227365

(51) Int. Cl.
*H05B 33/08* (2020.01)
*H05B 45/20* (2020.01)
*H05B 45/10* (2020.01)

(52) U.S. Cl.
CPC ..... *H05B 45/20* (2020.01); *H05B 45/10* (2020.01)

(58) Field of Classification Search
CPC ..... H05B 33/0851; H05B 33/0863; H05B 33/0866; H05B 37/0218; H05B 37/0227; H05B 37/0236; H05B 37/0272; H04N 5/2256; H04N 5/2354; H04N 33/0869
USPC ..... 315/152, 158, 200 A; 348/370, 371; 396/164, 200
See application file for complete search history.

(56) References Cited

U.S. PATENT DOCUMENTS 5,895,128 A * 4/1999 Kishimoto ..... G03B 15/05 396/182
8,160,435 B2 * 4/2012 Okubo ..... G03B 15/05 396/175
8,830,348 B2 * 9/2014 Nomura ..... H04N 9/735 348/223.1
8,896,587 B2 11/2014 Nakamura
9,110,355 B1 * 8/2015 Nourbakhsh ..... G03B 15/05
9,907,137 B1 * 2/2018 Lebens ..... H05B 47/10
2004/0263678 A1 * 12/2004 Kawakami ..... H04N 5/2354 348/371
2005/0212955 A1 * 9/2005 Craig ..... H04N 5/232 348/362

(Continued)

FOREIGN PATENT DOCUMENTS

JP 5311693 B2 10/2013

*Primary Examiner* — Tung X Le
(74) *Attorney, Agent, or Firm* — Rossi, Kimms & McDowell LLP

(57) ABSTRACT

A strobe device for use with an external camera. Assist continuous light is emitted using first and second LEDs different in color temperature. The color temperature of the assist continuous light is adjusted by either lighting one of the first and second LEDs or simultaneously lighting both at an adjusted light amount ratio. When in a still image pre-check mode, it is determined whether not a color temperature of an ambient light is higher than a threshold value. If the color temperature is higher than the threshold value, the light amount ratio is adjusted such that the light amount of the first LED is larger than that of the second LED, whereas if not, the light amount ratio is adjusted such that the light amount of the second LED is larger than that of the first LED.

11 Claims, 7 Drawing Sheets

(56) References Cited

U.S. PATENT DOCUMENTS

| | | | | |
|---|---|---|---|---|
| 2011/0187920 | A1* | 8/2011 | Shimada | H04N 5/222<br>348/371 |
| 2012/0154627 | A1* | 6/2012 | Rivard | G03B 15/02<br>348/224.1 |
| 2015/0304620 | A1* | 10/2015 | Guyomarc'h | H04N 9/735<br>348/224.1 |
| 2019/0297701 | A1* | 9/2019 | Cao | H05B 45/20 |

* cited by examiner

STROBE DEVICE CAPABLE OF EMITTING ASSIST CONTINUOUS LIGHT, AND METHOD OF CONTROLLING SAME

BACKGROUND OF THE INVENTION

Field of the Invention

The present invention relates to a strobe device and a method of controlling the same, and more particularly to a strobe device that emits not only flashlight used for shooting still images, but also assist continuous light, and a method of controlling the same.

Description of the Related Art

In recent years, an LED that is advantageous in low-voltage operation, high efficiency, and compactness has come to be used in an external strobe mounted on an accessory shoe of a camera, as an assist continuous light source.

Here, the assist continuous light refers to light used e.g. as light for still image pre-check of lighting conditions (hereinafter referred to as the modeling light) and light for moving image shooting (hereinafter referred to as the video light).

The modeling light is assist continuous light lighted when a photographer performs pre-shooting check of lighting conditions, such as the checking of a direction of light irradiated onto an object, how a shadow of an object appears, and focusing in a dark place, before the strobe performs main light emission, i.e. before exposure for still image shooting using the strobe is performed by the camera. As the color of light emitted by the modeling light, a light bulb color (approximately 3000 K) is mostly used. This is because in a case where the background is e.g. a white wall, there is a large difference in color from the modeling light which is the light bulb color, so that this enables a photographer to easily check how a shadow of an object appears. Further, the light bulb color has a wavelength more different from the wavelength of the maximum human spectral luminous efficiency than a white light, and hence the light bulb color has an advantage that a person as an object does not feel dazzling even when the modeling light is lighted.

On the other hand, the video light is assist continuous light lighted as assist light during moving image shooting. As the color of light lighted as the video light, a daytime white color (approximately 5000 K) is mostly used. Further, some cameras are capable of adjusting video light to the same color temperature of an ambient light so as to prevent the video light from being too conspicuously bright.

In a case where the modeling light and the video light are used in combination, if the color temperature is adjusted to one suitable for the modeling light, the image captured using the video light becomes reddish. Inversely, if the color temperature is adjusted to one suitable for the video light, the modeling light becomes white light, and hence the assist continuous light gives dazzling feeling to a person as an object.

There have been disclosed a lot of known techniques for making the color temperature closer to the ambient light by using a plurality of LEDs different in color temperature. For example, in Japanese Patent No. 5311693, different types of light emitted from two LEDs different in color temperature are mixed, whereby the color temperature of the mixed light is made closer to the ambient light based on white balance data under an image shooting environment.

However, in the conventional technique disclosed in Japanese Patent No. 5311693, the color temperature is adjusted to the ambient light. Therefore, even if the color temperature to which the video light is adjusted is an appropriate color temperature for the video light, the modeling light adjusted to the same color temperature as that of the environment light has no difference in the color temperature of light, so that it is difficult to know where the light of the modeling light is irradiated, i.e. the visibility of the assist continuous light is lowered.

SUMMARY OF THE INVENTION

The present invention provides a strobe device that increases the visibility of assist continuous light and makes it easy to perform pre-shooting check of lighting conditions, which is performed before executing main light emission, and a method of controlling the same.

In a first aspect of the present invention, there is provided a strobe device for use with an external camera, including a flashlight emission section, and an assist continuous light section which emits an assist continuous light using first and second LEDs which emit lights different in color temperature from each other, respectively, comprising at least one processor or circuit configured to perform the operations of the following units, an adjustment unit configured to adjust a color temperature of the assist continuous light by either lighting one of the first and second LEDs or simultaneously lighting the first and second LEDs at an adjusted light amount ratio between the two LEDs, a first determination unit configured to determine whether a lighting mode of the assist continuous light section is a still image pre-check mode or a moving image mode, a color temperature acquisition unit configured to acquire a color temperature of an ambient light, and a second determination unit configured to determine, in a case where it is determined by the first determination unit that the lighting mode is the still image pre-check mode, whether or not the color temperature is higher than a threshold value, wherein the adjustment unit adjusts, in a case where it is determined by the second determination unit that the color temperature is higher than the threshold value, the light amount ratio such that a light amount of the first LED is larger than a light amount of the second LED, and adjusts, in a case where it is determined by the second determination unit that the color temperature is not higher than the threshold value, the light amount ratio such that the light amount of the second LED is larger than the light amount of the first LED.

In a second aspect of the present invention, there is provided a strobe device for use with an external camera, including a flashlight emission section, and an assist continuous light section which emits an assist continuous light using first and second LEDs which emit lights different in color temperature from each other, respectively, comprising at least one processor or circuit configured to perform the operations of the following units, an adjustment unit configured to adjust a color temperature of the assist continuous light by either lighting one of the first and second LEDs or simultaneously lighting the first and second LEDs at an adjusted light amount ratio between the two LEDs, a determination unit configured to determine whether a lighting mode of the assist continuous light section is a still image pre-check mode or a moving image mode, and a color temperature acquisition unit configured to acquire a color temperature of an ambient light, wherein the adjustment unit lights the first LED, in a case where it is determined by the determination unit that the lighting mode is the still image pre-check mode, and adjusts, in a case where it is determined by the determination unit that the lighting mode is the moving image mode, the light amount ratio such that the color temperature of the assist continuous light becomes a predetermined color temperature within a range between a color temperature of the first LED and a color temperature of the second LED, and simultaneously lights the first and second LEDs at the adjusted light amount ratio.

In a third aspect of the present invention, there is provided a method of controlling a strobe device for use with an external camera, including a flashlight emission section, and an assist continuous light section which emits an assist continuous light using first and second LEDs which emit lights different in color temperature from each other, respectively, comprising adjusting a color temperature of the assist continuous light by either lighting one of the first and second LEDs or simultaneously lighting the first and second LEDs at an adjusted light amount ratio between the two LEDs, determining whether a lighting mode of the assist continuous light section is a still image pre-check mode or a moving image mode, acquiring a color temperature of an ambient light, and determining, in a case where it is determined that the lighting mode is the still image pre-check mode, whether or not the color temperature is higher than a threshold value, wherein said adjusting includes adjusting, in a case where it is determined by the second determination unit that the color temperature is higher than the threshold value, the light amount ratio such that a light amount of the first LED is larger than a light amount of the second LED, and adjusting, in a case where it is determined that the color temperature is not higher than the threshold value, the light amount ratio such that the light amount of the second LED is larger than the light amount of the first LED.

In a fourth aspect of the present invention, there is provided a method of controlling a strobe device for use with an external camera, including a flashlight emission section, and an assist continuous light section which emits an assist continuous light using first and second LEDs which emit lights different in color temperature from each other, respectively, comprising adjusting a color temperature of the assist continuous light by either lighting one of the first and second LEDs or simultaneously lighting the first and second LEDs at an adjusted light amount ratio between the two LEDs, determining whether a lighting mode of the assist continuous light section is a still image pre-check mode or a moving image mode, and acquiring a color temperature of an ambient light, wherein said adjusting includes lighting the first LED, in a case where it is determined that the lighting mode is the still image pre-check mode, and adjusting, in a case where it is determined that the lighting mode is the moving image mode, the light amount ratio such that the color temperature of the assist continuous light becomes a predetermined color temperature within a range between a color temperature of the first LED and a color temperature of the second LED, and simultaneously lighting the first and second LEDs at the adjusted light amount ratio.

According to the present invention, it is possible to increase the visibility of the assist continuous light, and it is easy to perform pre-shooting check of lighting conditions, which is performed before executing main light emission.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
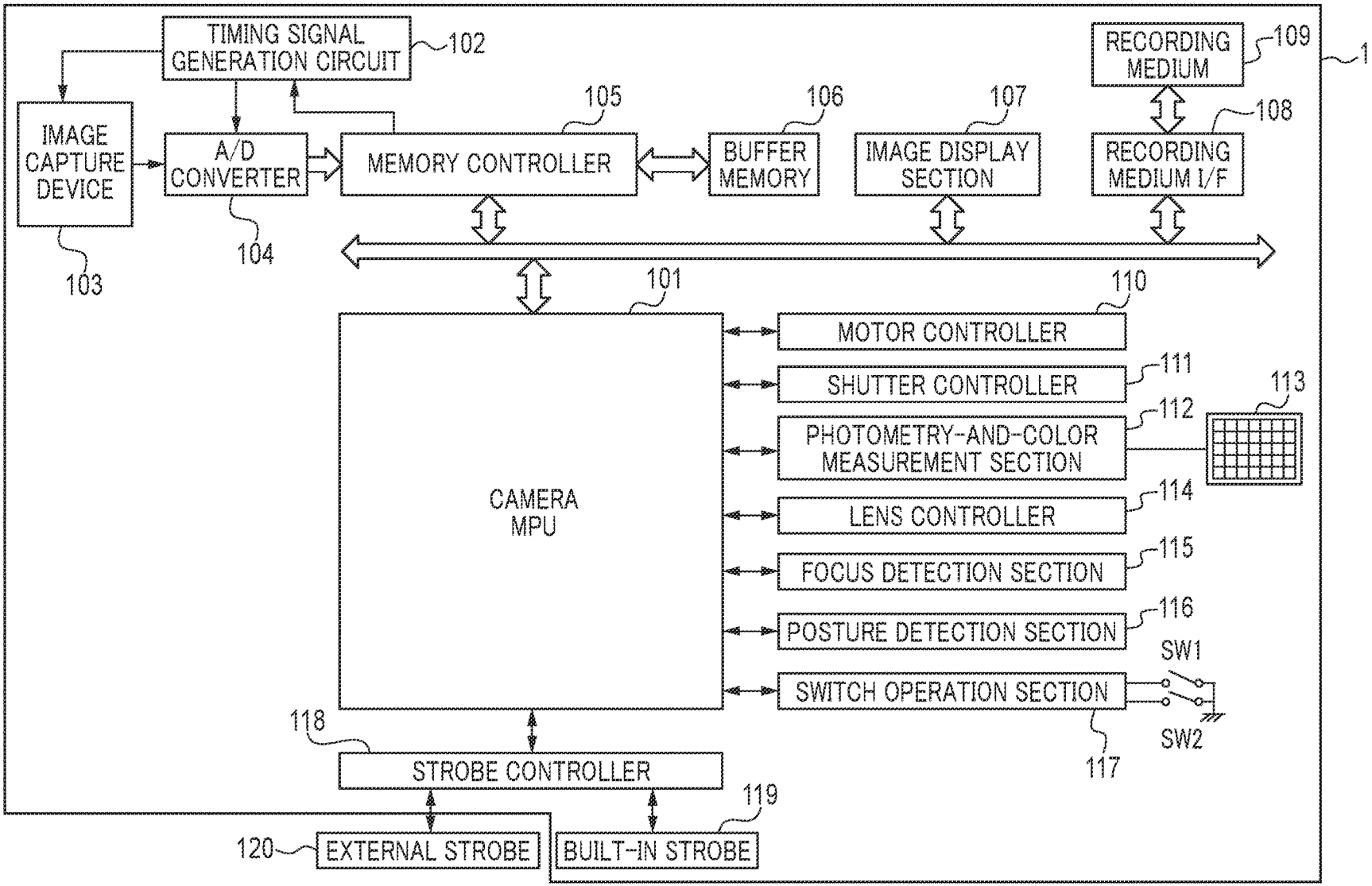
FIG. 1 is a block diagram showing a hardware configuration of a camera including a strobe device according to a first embodiment.

First, a description will be given of the configuration of a camera 1 including an external strobe 120 as a strobe device according to a first embodiment with reference to a block diagram in FIG. 1.

The camera 1 includes a camera MPU 101, a timing signal generation circuit 102, an image capture device 103, an analog-to-digital converter 104, a memory controller 105, a buffer memory 106, an image display section 107, a recording medium interface 108, a recording medium 109, and a motor controller 110. Further, the camera 1 includes a shutter controller 111, a photometry-and-color measurement section 112, a photometry-and-color measurement sensor 113, a lens controller 114, a focus detection section 115, a posture detection section 116, a switch operation section 117, a strobe controller 118, a built-in strobe 119, and the external strobe 120.

The camera MPU 101 is a microcontroller for controlling the overall operation of the camera 1, including a shooting sequence.

The image capture device 103 is implemented by a CCD or CMOS sensor that converts reflected light from an object to electrical signals.

The timing signal generation circuit 102 generates a timing signal necessary for operating the image capture device 103.

The analog-to-digital converter 104 converts analog image data read from the image capture device 103 to digital image data.

The memory controller 105 controls operations for writing data into the buffer memory 106 and reading data from the same, an operation for refreshing the buffer memory 106, and so forth.

The image display section 107 displays image data stored in the buffer memory 106.

The recording medium interface 108 is an interface for connecting the camera 1 with the recording medium 109, such as a memory card and a hard disk.

The motor controller 110 controls a motor, not shown, according to a signal output from the camera MPU 101 when performing an exposure operation, to thereby move up and down a mirror, not shown, and charge a shutter, not shown.

The shutter controller 111 controls the exposure operation by stopping energization of electromagnets which attract and hold a shutter front curtain and a shutter rear curtain, neither of which is shown, to start running of the curtains, respectively.

The photometry-and-color measurement sensor 113 measures a luminance and a color temperature in each area within a screen thereof in response to an instruction from the photometry-and-color measurement section 112, and outputs results of the measurement to the photometry-and-color measurement section 112.

The photometry-and-color measurement section 112 outputs the information on the luminance and the color temperature, which is output from the photometry-and-color measurement sensor 113, to the camera MPU 101. The camera MPU 101 performs photometry calculation for calculating an AV (aperture value), a TV (shutter speed), an ISO (sensitivity of the image capture device), etc., for adjusting the exposure for shooting based on the luminance information. Further, the photometry-and-color measurement section 112 outputs information on a luminance detected when the built-in strobe 119 or the external strobe 120 has performed preliminary light emission toward an object, to the camera MPU 101, and the camera MPU 101 calculates a light emission amount for main light emission to be performed by the built-in strobe 119 or the external strobe 120 for strobe shooting. On the other hand, the information on the color temperature, which is output from the photometry-and-color measurement section 112 to the camera MPU 101, is used for detection of an object, and the accuracy of AF (auto focus) is improved by combining this information with information output from the focus detection section 115. For example, although, the AF function has been conventionally easy to focus on an object on the near side, in a case where there is a person on the far side, it is possible to preferentially focus on the person by recognizing a skin color based on this color temperature information.

The lens controller 114 communicates with the camera MPU 101 via a lens mount contact point, not shown, and causes a lens drive motor and a lens diaphragm motor, neither of which is shown, to operate to thereby control focus adjustment of the lens and the aperture.

The focus detection section 115 detects a defocus amount with respect to an object, for use in the AF (auto focus) operation, e.g. by a phase difference detection method, which is a conventional technique.

The posture detection section 116 detects a tilt of the camera 1 in a direction of rotation about an optical axis.

The switch operation section 117 is an operation member of the camera 1 and performs control according to ON/OFF signals of a SW1 and a SW2. The SW1 is turned on by a first stroke (e.g. a half-press operation) of a release button, not shown, to cause the camera MPU 101 to start the AF operation and the photometry operation. The SW2 is turned on by a second stroke (e.g. a full-press operation) of the release button to cause the camera MPU 101 to start the exposure operation. The switch operation section 117 detects signals from other operation members of the camera 1, not shown, and sends the detected signals to the camera MPU 101.

The strobe controller 118 performs light emission processing e.g. for setting a light emission pattern (such as a preliminary light emission instruction and a main light emission instruction) and for setting a light emission amount used for the main light emission. Further, communication with the built-in strobe 119 and the external strobe 120 is performed via the strobe controller 118.

Figure 2:
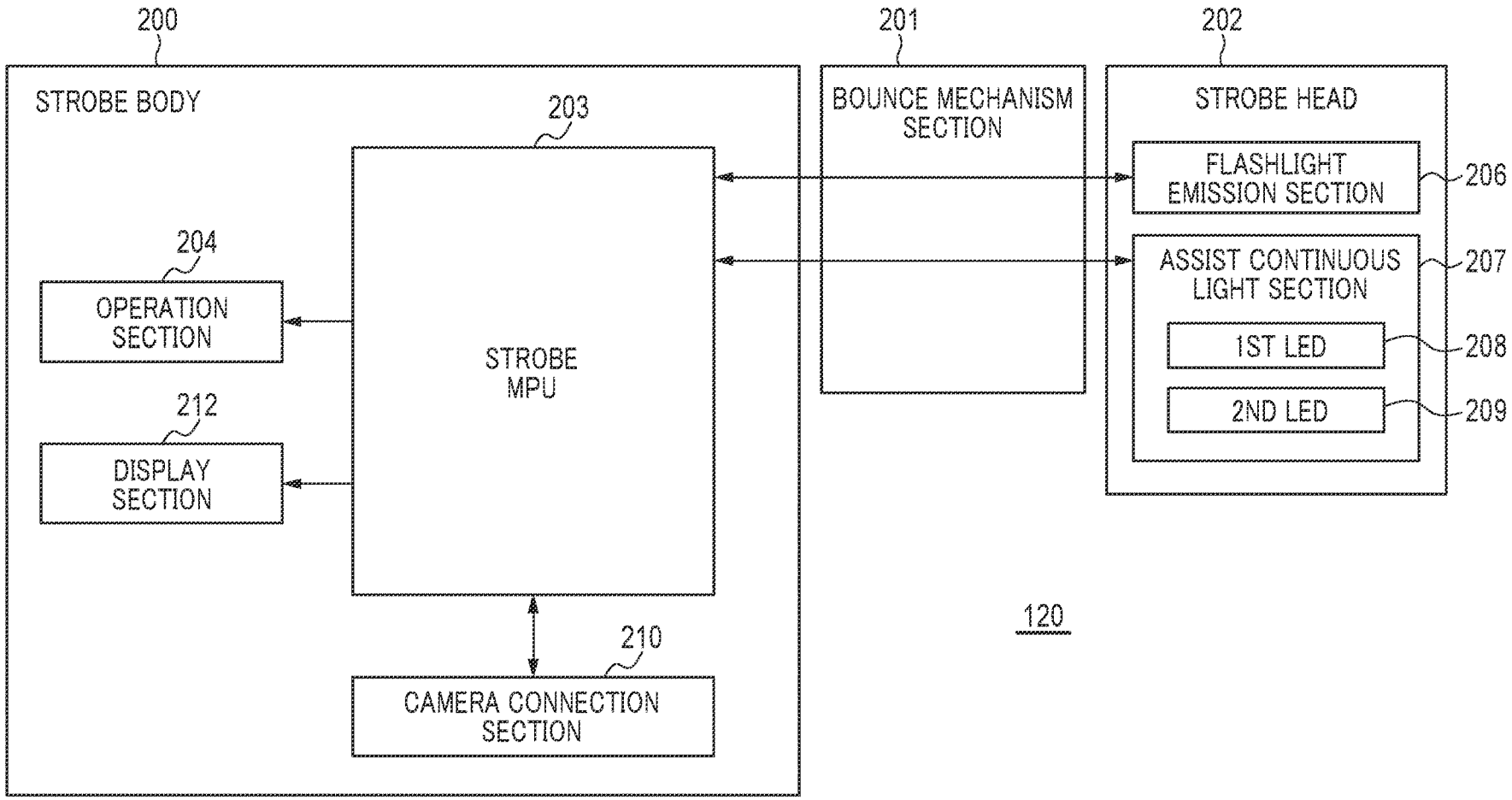
FIG. 2 is a block diagram showing a hardware configuration of an external strobe appearing in FIG. 1.

Next, the hardware configuration of the external strove 120 will be described with reference to FIG. 2.

The external strobe 120 includes a strobe body 200, a bounce mechanism section 201, and a strobe head 202.

In the strobe body 200, there are arranged a strobe MPU 203 that controls the overall operation of the external strobe 120, an operation section 204 formed by a power switch, an assist continuous light ON/OFF button, etc., a display section 212, a camera connection section 210, and so forth.

In the bounce mechanism section 201, there are arranged a main capacitor, not shown, and so forth. The bounce mechanism section 201 is an irradiation direction variable mechanism of the external strobe 120 and holds the strobe head 202 such that the strobe head 202 is rotatable in a horizontal direction and a vertical direction with respect to the strobe body 200. With this configuration, it is possible to perform bounce shooting in which the irradiation direction of strobe light emission from the external strobe 120 is changed.

In the strobe head 202, there are arranged a flashlight emission section 206 necessary for strobe light emission and an assist continuous light section 207, described hereinafter.

The strobe MPU 203 is a microcontroller of the external strobe 120, for performing control on a flashlight emission control sequence, an assist continuous light control sequence, an instruction for acquiring photometry and color measurement information, and determination of a lighting mode of the assist continuous light section 207.

The flashlight emission section 206 of the strobe head 202 includes a strobe light emission circuit, not shown, for emitting flashlight in response to a light emission signal output from the strobe MPU 203. Further, the flashlight emission section 206 is comprised of a flashlight emission tube, such as a xenon tube, not shown, necessary for strobe light emission, a reflection umbrella, not shown, a Fresnel lens 211 described hereinafter with reference to FIG. 3A, and so forth.

The assist continuous light section 207 is comprised of a first LED 208, a second LED 209, and assist continuous light lens sections 211*a*, described hereinafter with reference to FIGS. 3A and 3B, formed in respective portions of the Fresnel lens 211. The assist continuous light lens sections 211*a* are lenses for adjusting light distribution of the first LED 208 and the second LED 209, and are arranged in front of the first LED 208 and the second LED 209, respectively. The color temperature of the first LED 208 is set to a light bulb color temperature (3000 K) while the color temperature of the second LED 209 is set to a daylight color temperature (6500 K). The assist continuous light is emitted by lighting one of the first LED 208 and the second LED 209 or simultaneously lighting the first LED 208 and the second LED 209 at an adjusted light amount ratio therebetween, according to a light emission signal output from the strobe MPU 203. The strobe MPU 203 is also capable of adjusting the color temperature of the assist continuous light by adjusting the light amount ratio between the first LED 208 and the second LED 209 and mixing the colors of light by simultaneously lighting the first LED 208 and the second LED 209.

The camera connection section 210 is an interface for communicating between the external strobe 120 and the camera 1.

Figure 3A:
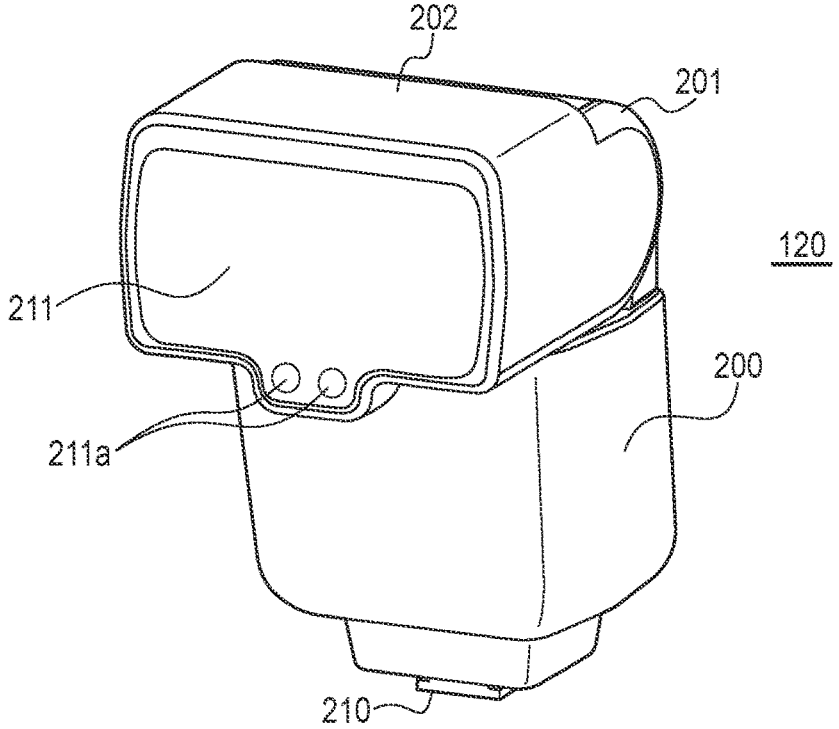
FIG. 3A is a front perspective view of the appearance of the external strobe.
Figure 3B:
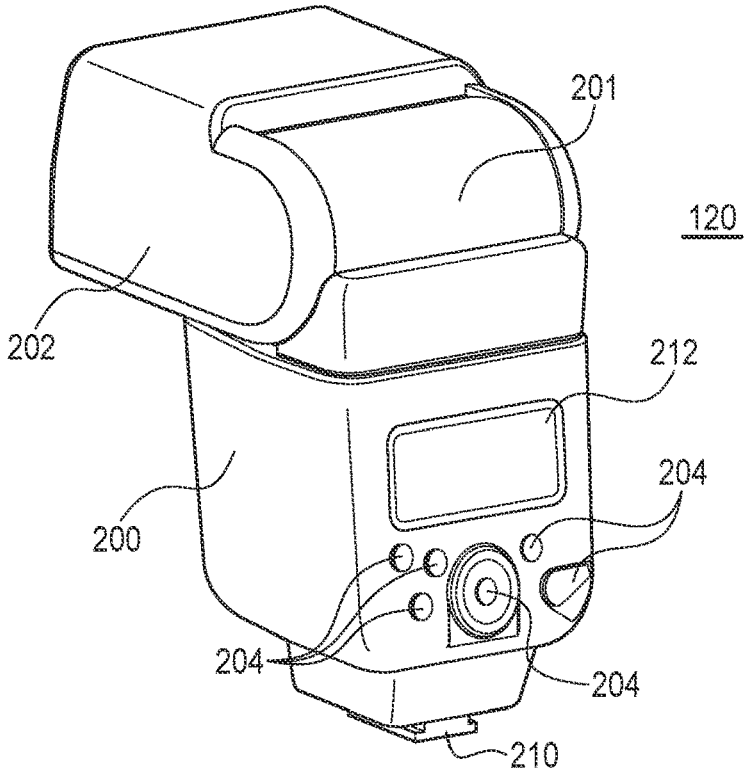
FIG. 3B is a rear perspective view of the appearance of the external strobe.

FIGS. 3A and 3B are views showing the appearance of the external strobe 120. FIG. 3A is a front side perspective view of the external strobe 120, as viewed from the side of the Fresnel lens 211 of the strobe head 202, and FIG. 3B is a rear-side perspective view of the same, as viewed from the side of the operation section 204 of the strobe body 200.

The Fresnel lens 211 allows light emitted from the flashlight emission tube of the flashlight emission section 206 and light reflected by the reflection umbrella of the same to pass therethrough, and adjusts light distribution to a predetermined angle. In the vicinity of a lower central portion of the Fresnel lens 211, the assist continuous light lens sections 211*a* are integrally formed so as to adjust light emitted from the first LED 208 and the second LED 209 to irradiate a target at a distance corresponding to a predetermined focal length. The first LED 208 and the second LED 209 are arranged in the lower central portion of the Fresnel lens 211 so as not to interfere with light emitted from the flashlight emission tube of the flashlight emission section 206 and light reflected from the reflection umbrella of the same. Further, the first LED 208 and the second LED 209 are arranged as described above because the assist continuous light is used as modeling light for checking the direction of flashlight and how a shade appears before executing main light emission for strobe shooting, and hence it is desirable to prevent the optical axis of flashlight emitted from the flashlight emission tube and the optical axis of the assist continuous light emitted from the assist continuous light section 207 from being displaced from each other.

The following description will be given of the operation of the external strobe 120 as the strobe device according to the present embodiment with reference to FIGS. 4 and 5.

Figure 4:
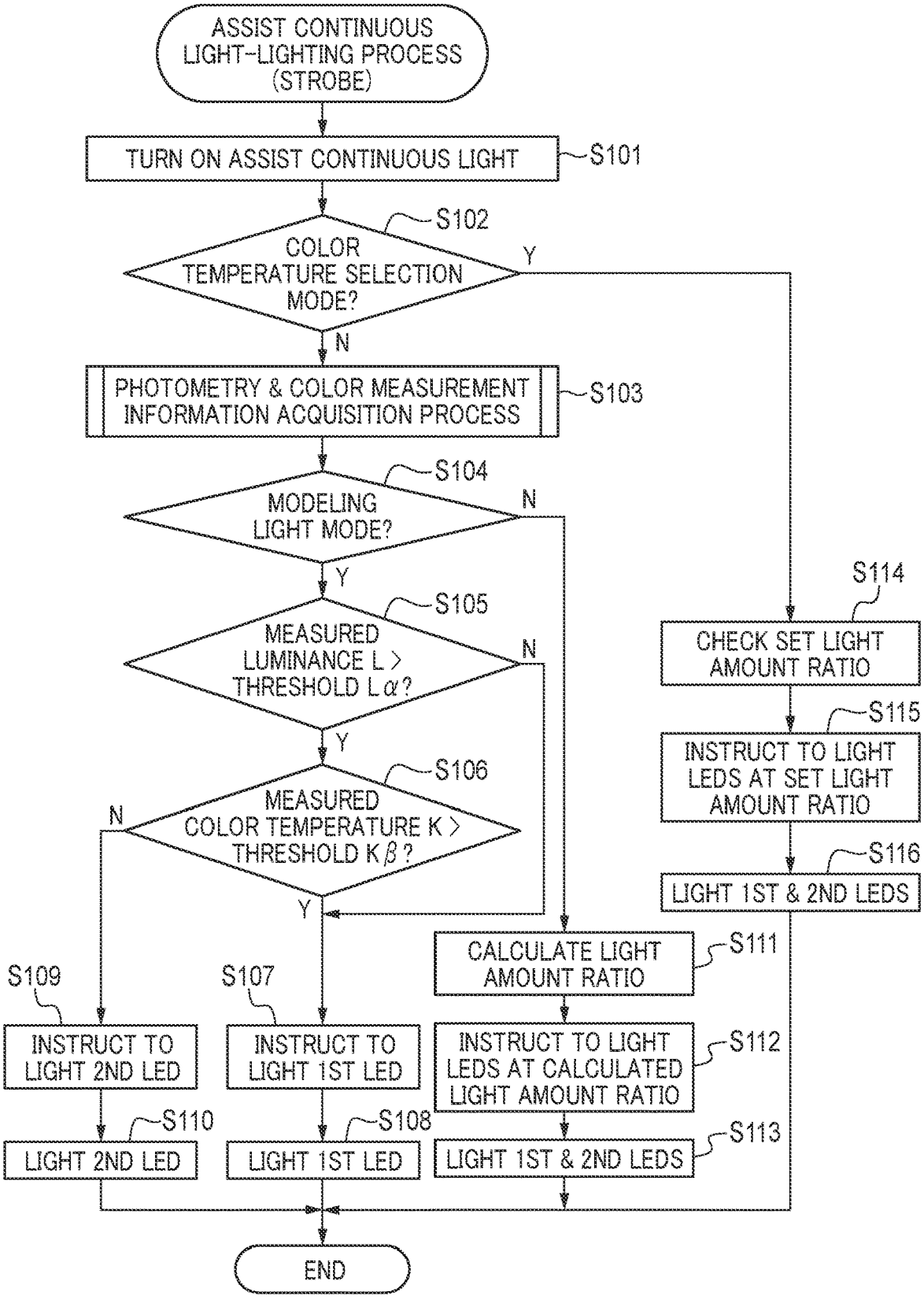
FIG. 4 is a flowchart of an assist continuous light-lighting process performed by the strobe device according to the first embodiment.
Figure 5:
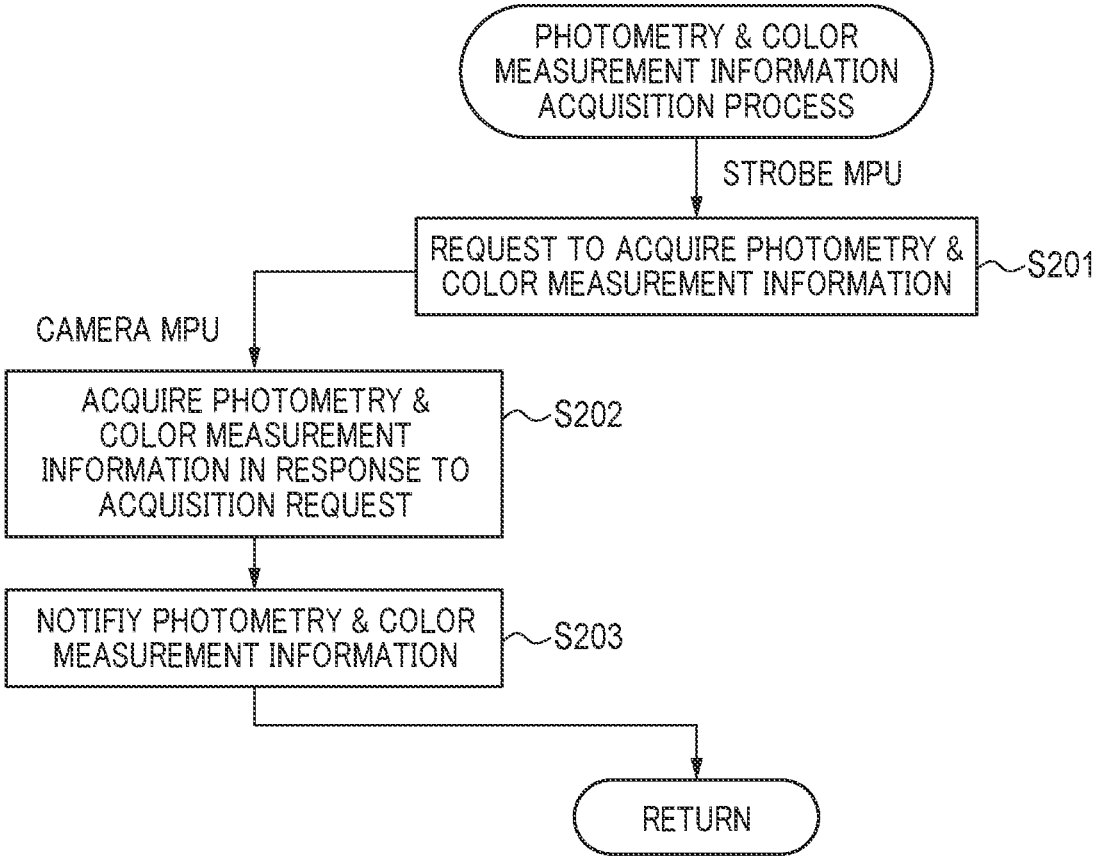
FIG. 5 is a flowchart of a photometry and color measurement information acquisition process executed in a step of the assist continuous light-lighting process in FIG. 4.

FIG. 4 is a flowchart of an assist continuous light-lighting process performed by the strobe MPU 203 of the external strobe 120. Note that in the present embodiment, the lighting mode of the assist continuous light section 207 is set by a user in advance.

In a step S101, when it is detected that a user has pressed the assist continuous light ON/OFF button of the operation section 204 of the external strobe 120, the strobe MPU 203 turns on the assist continuous light.

In a step S102, the strobe MPU 203 determines whether or not the lighting mode of the assist continuous light section 207 is a color temperature selection mode in which the user sets the color temperature as desired. If the lighting mode is the color temperature selection mode, the process proceeds to a step S114. If the lighting mode is not the color temperature selection mode, the process proceeds to a step S103.

In the step S103, the strobe MPU 203 performs a photometry and color measurement information acquisition process for acquiring photometry and color measurement information. Details of this process will be described hereinafter with reference to FIG. 5.

In a step S104, the strobe MPU 203 determines whether or not the lighting mode of the assist continuous light section 207 is a modeling light mode. The modeling light mode (still image pre-check mode) is a lighting mode for performing pre-shooting check of lighting conditions, including checking of how flashlight emitted from the strobe irradiates an object, by lighting the assist continuous light before executing the main light emission for still image shooting using the strobe. If the lighting mode is the modeling light mode, the process proceeds to a step S105. If the lighting mode is not the modeling light mode, it is determined that the lighting mode is a video light mode, so that the process proceeds to a step S111. The video light mode (moving image mode) is a lighting mode for using the assist continuous light as the assist light in moving image shooting.

In the step S105, the strobe MPU 203 determines whether or not a luminance L of the ambient light, which has been acquired in the step S103, is higher than a threshold value La. If the luminance L of the ambient light is higher than the threshold value La, the process proceeds to a step S106. If the luminance L of the ambient light is not higher than the threshold value La, i.e. if the modeling light is used under a dark environment, it is not dazzling and more appropriate to light the first LED 208 which is lower in color temperature, and hence the process proceeds to a step S107. Here, the threshold value La may be set to a lowest luminance at which the focus detection section 115 of the camera 1 can detect a focal point or may be set to a lowest luminance at which the user can visually confirm a difference from the shooting ambient light when the first LED 208 is lighted. It is difficult for the human eye to discriminate colors under a dark environment and hence not color but brightness is important.

In the step S106, the strobe MPU 203 determines whether or not a color temperature K of the ambient light, which has been acquired in the step S103, is higher than a threshold value Kβ. If the color temperature K of the ambient light is higher than the threshold value Kβ, the process proceeds to a step S107. If the color temperature K of the ambient light is not higher than the threshold value Kβ, the process proceeds to a step S109. Here, the threshold value Kβ is only required to be a value within a range between 3000 K which is the color temperature of the first LED 208 and 6500 K which is the color temperature of the second LED 209, and in the present embodiment, it is set to 4000 K.

In the step S107, the strobe MPU 203 instructs the assist continuous light section 207 to light the first LED 208, and in a step S108, the assist continuous light section 207 lights the first LED 208, followed by terminating the present process.

In the step S109, the strobe MPU 203 instructs the assist continuous light section 207 to light the second LED 209, and in a step S110, the assist continuous light section 207 lights the second LED 209, followed by terminating the present process.

The process in the step S111 et seq. is a process to be performed after it is determined in the step S104 that the lighting mode is not the modeling light mode, but the video light mode. The video light mode is a lighting mode in which an object is lighted in an auxiliary way when performing moving image shooting to thereby compensate for insufficiency of brightness.

In the step S111, the strobe MPU 203 calculates a light amount ratio between the first LED 208 and the second LED 209 so as to make the color temperature closer to the color temperature of the ambient light, which is acquired in the step S103.

In a step S112, the strobe MPU 203 instructs the assist continuous light section 207 to light the first LED 208 and the second LED 209 at the light amount ratio calculated in the step S111.

In a step S113, the assist continuous light section 207 lights the first LED 208 and the second LED 209 at the light amount ratio calculated in the step S111, followed by terminating the present process.

The process in the step S114 et seq. is a process to be performed after it is determined in the step S102 that the lighting mode is a color temperature selection mode.

In the step S114, the strobe MPU 203 checks a set value of the color temperature, which has been set by the user and recorded in advance, i.e. a set light amount ratio between the first LED 208 and the second LED 209.

In a step S115, the strobe MPU 203 instructs the assist continuous light section 207 to light the first LED 208 and the second LED 209 at the set light amount ratio checked in the step S114.

In a step S116, the assist continuous light section 207 lights the first LED 208 and the second LED 209 at the set light amount ratio instructed by the lighting instruction received in the step S115, followed by terminating the present process.

Next, details of the photometry and color measurement information acquisition process in the step S103 in FIG. 4 will be described with reference to a flowchart shown in FIG. 5.

In a step S201, the strobe MPU 203 requests the camera MPU 101 via the camera connection section 210 to acquire the photometry and color measurement information, i.e. the luminance L and the color temperature K of the ambient light (respective operations of a color temperature acquisition unit and a luminance acquisition unit).

In a step S202, the camera MPU 101 causes the photometry-and-color measurement section 112 to perform the photometry and color measurement operation using the photometry-and-color measurement sensor 113 to thereby acquire the photometry and color measurement information in response to the request from the strobe MPU 203.

In a step S203, the camera MPU 101 notifies the strobe MPU 203 of the photometry and color measurement information via the camera connection section 210, followed by terminating the present process.

As described above, in the present embodiment, based on the lighting mode set by a user in advance, when the lighting mode is the modeling light mode, the assist continuous light section 207 automatically selects the color temperature of the assist continuous light and lights an LED such that a difference from the ambient light is generated. This increases the visibility of the assist continuous light and makes it easy to perform pre-shooting check of lighting conditions before executing the main light emission. On the other hand, when the lighting mode is the video light mode, the assist continuous light section 207 automatically adjusts the color temperature of the assist continuous light and lights the LEDs such that the color temperature of the assist continuous light is made equal to the color temperature of the ambient light to thereby reduce conspicuous brightness of the assist continuous light. Therefore, it is possible to automatically adjust the color temperature in accordance with the lighting mode of the assist continuous light section 207.

Although in the present embodiment, the luminance information and the color temperature information are acquired by using the photometry-and-color measurement sensor 113 of the camera 1, in a case where a mirrorless camera is used or live view shooting is performed, the luminance information and the color temperature information may be acquired from the image capture device 103 of the camera 1. Further, the information may be acquired by equipping the photometry-and-color measurement sensor in the external strobe 120. In this case, the photometry-and-color measurement sensor is disposed at an end of the same surface as the Fresnel lens 211. By doing this, it is possible to arrange the flashlight emission section 206, the assist continuous light section 207, and the photometry-and-color measurement sensor, such that they are oriented in the same direction. Particularly in a case where multi-light shooting is to be performed, the external strobe 120 is not necessarily connected to the camera 1, and hence by making the external strobe 120 capable of acquiring the photometry and color measurement information by itself, it is possible to automatically adjust the color temperature in accordance with the assist light mode even by the external strobe 120 alone.

Further, although in the present embodiment, the luminance information and the color temperature information of the ambient light are acquired by using the photometry-and-color measurement sensor 113 to control the color temperature of the assist continuous light section 207, this is not limitative. For example, detection information of a main object based on the color information obtained using the photometry-and-color measurement sensor 113 may be used for the control of the color temperature of the assist continuous light section 207. More specifically, in a case where the main object is detected to be a person by detecting a skin color, the color temperature of the assist continuous light section 207 may be adjusted to be closer to the light bulb color temperature so as to prevent the person from feeling dazzling. On the other hand, in a case where the main object is detected to be not a person, the color temperature of the assist continuous light section 207 may be adjusted such that a difference in color from the main object is generated.

Further, although in the present embodiment, one of the first and second LEDs 208 and 209 is lighted according to a result of comparison between the color temperature K of the ambient light and the threshold value Kβ, the first and second LEDs 208 and 209 may be simultaneously lighted within a range in which the color temperature is not adversely affected. Further, the assist continuous light section 207 may be controlled so as to increase the light amount by setting the light amount ratio such that the color temperature is made closer to the color temperature of one of the first and second LEDs 208 and 209, and simultaneously lighting the first and second LEDs 208 and 209 at the set light amount ratio.

Figure 6:
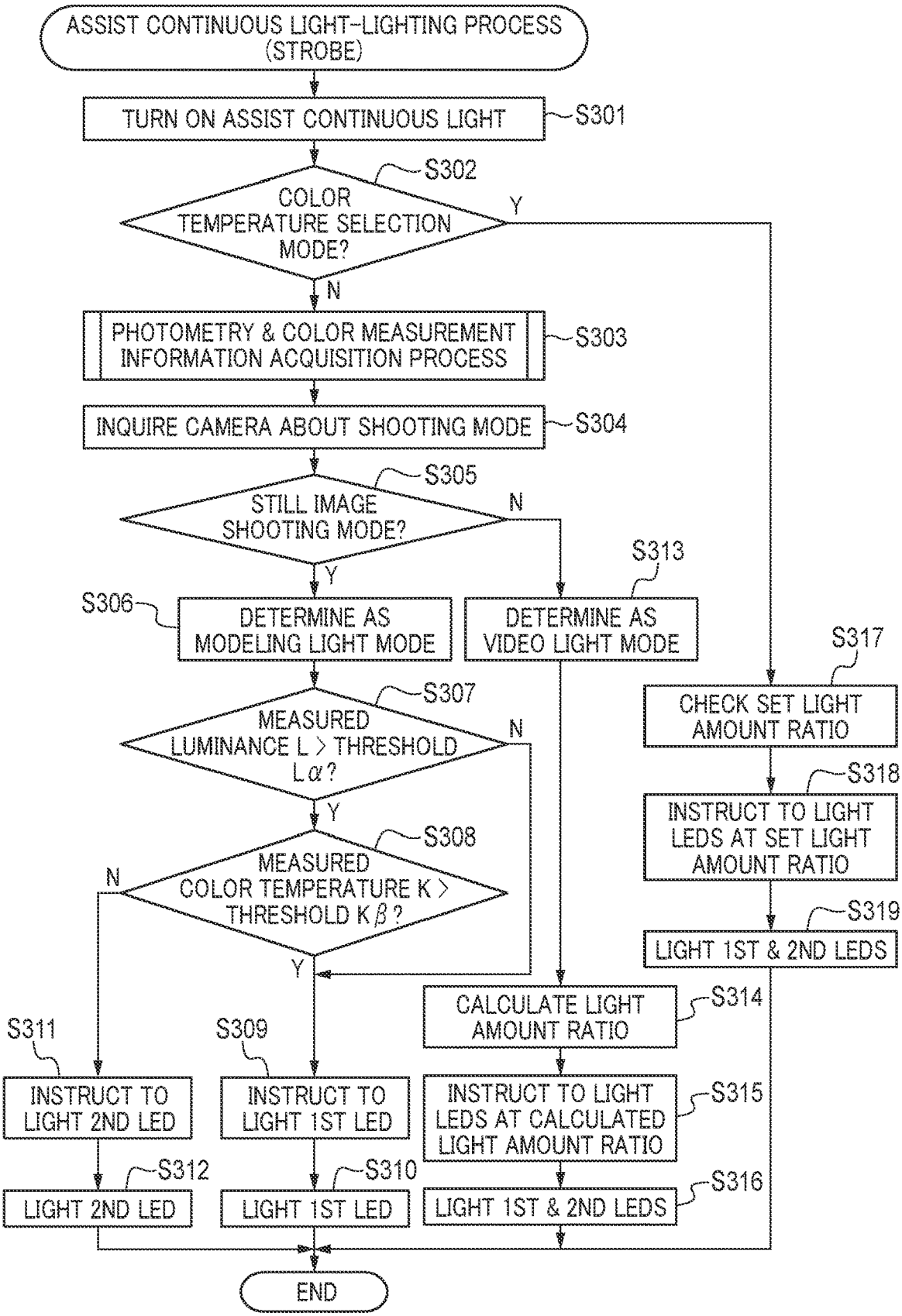
FIG. 6 is a flowchart of an assist continuous light-lighting process performed by a strobe device according to a second embodiment.

The following description will be given of assist continuous light-lighting process performed by the external strobe 120 as a strobe device according to a second embodiment, with reference to a flowchart shown in FIG. 6. Note that the hardware configuration of the second embodiment is the same as that of the first embodiment, and hence the same component elements are denoted by the same reference numerals, and redundant description is omitted.

In a step S301, when it is detected that a user has pressed the assist continuous light ON/OFF button of the operation section 204 of the external strobe 120, the strobe MPU 203 turns on the assist continuous light.

In a step S302, the strobe MPU 203 determines whether or not the lighting mode of the assist continuous light section 207 is the color temperature selection mode in which the user sets the color temperature as desired. If the lighting mode is the color temperature selection mode, the process proceeds to a step S317. If the lighting mode is not the color temperature selection mode, the process proceeds to a step S303.

In the step S303, the strobe MPU 203 performs the photometry and color measurement information acquisition process for acquiring the photometry and color measurement information, which is described in detail with reference to FIG. 5.

In a step S304, the strobe MPU 203 sends a query about the shooting mode of the camera 1 to the camera MPU 101 via the camera connection section 210. The shooting mode of the camera 1 refers to one of the still image shooting mode and the moving image shooting mode. The camera MPU 101 sends a response to this query to the strobe MPU 203 via the camera connection section 210, which indicates whether the shooting mode of the camera 1 is the still image shooting mode or the moving image shooting mode.

In a step S305, the strobe MPU 203 determines whether the response from the camera MPU 101 to the query sent in the step S304 indicates the still image shooting mode or the moving image shooting mode. If it is determined that the shooting mode of the camera 1 is the still image shooting mode, the process proceeds to a step S306. If it is determined that the shooting mode of the camera 1 is not the still image shooting mode but the moving image shooting mode, the process proceeds to a step S313.

In the step S306, the strobe MPU 203 determines that the lighting mode of the assist continuous light section 207 is the modeling light mode.

In the step S313, the strobe MPU 203 determines that the lighting mode of the assist continuous light section 207 is the video light mode.

In steps S307 to S312, and steps S314 to S319, the same processing operations as in the steps S105 to S108, and steps S111 to S116 are executed, and hence description thereof is omitted.

According to the present embodiment, it is possible to automatically set the lighting mode to one of the modeling light mode and the video light mode according to whether the shooting mode of the camera 1 is the still image shooting mode or the moving image shooting mode, and automatically adjust the color temperature to the one suitable for the set mode.

Figure 7:
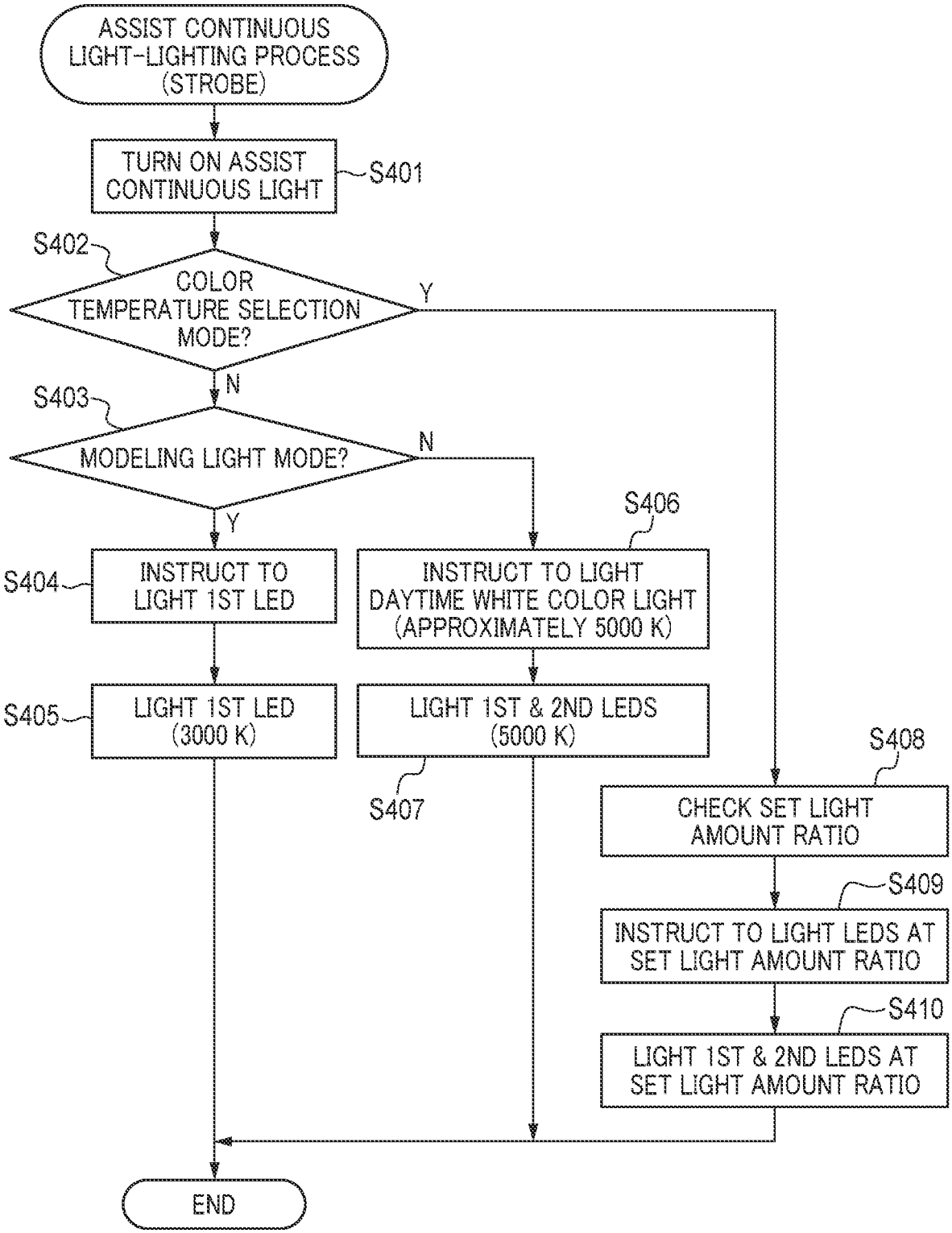
FIG. 7 is a flowchart of an assist continuous light-lighting process performed by a strobe device according to a third embodiment.

The following description will be given of an assist continuous light-lighting process performed by the external strobe 120 as a strobe device according to a third embodiment, with reference to a flowchart shown in FIG. 7. Note that the hardware configuration of the third embodiment is the same as that of the first embodiment, and hence the same component elements are denoted by the same reference numerals, and redundant description is omitted.

In a step S401, when it is detected that a user has pressed the assist continuous light ON/OFF button of the operation section 204 of the external strobe 120, the strobe MPU 203 turns on the assist continuous light.

In a step S402, the strobe MPU 203 determines whether or not the lighting mode of the assist continuous light section 207 is the color temperature selection mode in which the user sets the color temperature as desired. If the lighting mode is the color temperature selection mode, the process proceeds to a step S408. If the lighting mode is not the color temperature selection mode, the process proceeds to a step S403.

In the step S403, the strobe MPU 203 determines whether or not the lighting mode of the assist continuous light section 207 is the modeling light mode. If the lighting mode is the modeling light mode, the process proceeds to a step S404. If the lighting mode is not the modeling light mode, it is determined that the lighting mode is the video light mode, and the process proceeds to a step S406.

In the step S404, the strobe MPU 203 instructs the assist continuous light section 207 to light the first LED 208, and in a step S405, the assist continuous light section 207 lights the first LED 208, followed by terminating the present process.

In the step S406, the strobe MPU 203 instructs the assist continuous light section 207 to light the first LED 208 and the second LED 209 at a light amount ratio at which the color temperature becomes equal to the color temperature of the daytime white color (approximately 5000 K).

In a step S407, the assist continuous light section 207 lights the first LED 208 and the second LED 209 at the light amount ratio instructed by the lighting instruction received in the step S406, followed by terminating the present process. Although in the present embodiment, lighting at the light amount ratio at which the color temperature becomes equal to 5000 K is instructed in the step S406, the color temperature is only required to be set to a color temperature higher than the color temperature of the first LED 208 (3000 K) and lower than the color temperature of the second LED 209 (6500 K). For example, the first LED 208 and the second LED 209 may be simultaneously lighted at a light amount ratio at which the color temperature becomes equal to a predetermined color temperature within a range from 4000 K to 6000 K.

The process in the step S408 et seq. is a process to be performed after it is determined in the step S402 that the lighting mode is the color temperature selection mode.

In the step S408, the strobe MPU 203 checks a set value of the color temperature, which has been set by the user and recorded in advance, i.e. a set light amount ratio between the first LED 208 and the second LED 209.

In a step S409, the strobe MPU 203 instructs the assist continuous light section 207 to light the first LED 208 and the second LED 209 at the set light amount ratio checked in the step S408.

In a step S410, the assist continuous light section 207 lights the first LED 208 and the second LED 209 at the set light amount ratio instructed by the lighting instruction received in the step S409, followed by terminating the present process.

As described above, according to the present embodiment, the strobe MPU 203 can set the color temperature of the assist continuous light according to the lighting mode of the assist continuous light section 207 even when the external strobe 120 is not connected to the camera 1 and does not have the photometry-and-color measurement sensor. That is, if the lighting mode is the modeling light mode, the assist continuous light is controlled to become the light bulb color, and if the lighting mode is the video light mode, the assist continuous light is controlled to become the daytime white color. This makes it possible to change the color temperature of the assist continuous light according to its lighting mode without performing complicated processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-227365, filed Dec. 4, 2018, which is hereby incorporated by reference herein in its entirety.

What is claimed is:

1. A strobe device for use with an external camera, including a flashlight emission section, and an assist continuous light section which emits an assist continuous light using first and second LEDs which emit lights different in color temperature from each other, respectively, comprising:

at least one processor or circuit configured to perform the operations of the following units:

an adjustment unit configured to adjust a color temperature of the assist continuous light by either lighting one of the first and second LEDs or simultaneously lighting the first and second LEDs at an adjusted light amount ratio between the two LEDs;

a first determination unit configured to determine whether a lighting mode of the assist continuous light section is a still image pre-check mode or a moving image mode;

a color temperature acquisition unit configured to acquire a color temperature of an ambient light; and a second determination unit configured to determine, in a case where it is determined by the first determination unit that the lighting mode is the still image pre-check mode, whether or not the color temperature is higher than a threshold value, wherein the adjustment unit adjusts, in a case where it is determined by the second determination unit that the color temperature is higher than the threshold value, the light amount ratio such that a light amount of the first LED is larger than a light amount of the second LED, and adjusts, in a case where it is determined by the second determination unit that the color temperature is not higher than the threshold value, the light amount ratio such that the light amount of the second LED is larger than the light amount of the first LED.

2. The strobe device according to claim 1, wherein the at least one processor or circuit configured to further perform the operation of a query unit configured to send a query to the camera about a shooting mode of the camera, wherein the first determination unit determines, in a case where a response to the query sent by the query unit, which is received from the camera, indicates that the shooting mode of the camera is a still image shooting mode, that the lighting mode of the assist continuous light section is the still image pre-check mode, and determines, in a case where the response indicates that the shooting mode of the camera is a moving image shooting mode, that the lighting mode of the assist continuous light section is the moving image mode.

3. The strobe device according to claim 2, wherein the color temperature acquisition unit acquires from the camera, information on the color temperature measured by a photometry-and-color measurement sensor included in the camera.

4. The strobe device according to claim 1, wherein the at least one processor or circuit configured to further perform the operation of a luminance acquisition unit configured to acquire a luminance of an ambient light, wherein in a case where it is determined by the first determination unit that the lighting mode is the still image pre-check mode, and at the same time, a luminance acquired by the luminance acquisition unit is not higher than a threshold value, the adjustment unit adjusts the light amount ratio such that the light amount of the first LED is larger than the light amount of the second LED.

5. The strobe device according to claim 4, wherein a luminance acquisition unit acquires from the camera, information on a luminance measured by a photometry-and-color measurement sensor included in the camera.

6. The strobe device according to claim 4, wherein the color temperature acquisition unit and the luminance acquisition unit are a photometry-and-color measurement sensor for measuring a color temperature and a luminance.

7. The strobe device according to claim 1, wherein the color temperature of the first LED is a light bulb color temperature, and the color temperature of the second LED is a daylight color temperature.

8. A strobe device for use with an external camera, including a flashlight emission section, and an assist continuous light section which emits an assist continuous light using first and second LEDs which emit lights different in color temperature from each other, respectively, comprising:

at least one processor or circuit configured to perform the operations of the following units:

an adjustment unit configured to adjust a color temperature of the assist continuous light by either lighting one of the first and second LEDs or simultaneously lighting the first and second LEDs at an adjusted light amount ratio between the two LEDs;

a determination unit configured to determine whether a lighting mode of the assist continuous light section is a still image pre-check mode or a moving image mode; and a color temperature acquisition unit configured to acquire a color temperature of an ambient light, wherein the adjustment unit lights the first LED, in a case where it is determined by the determination unit that the lighting mode is the still image pre-check mode, and adjusts, in a case where it is determined by the determination unit that the lighting mode is the moving image mode, the light amount ratio such that the color temperature of the assist continuous light becomes a predetermined color temperature within a range between a color temperature of the first LED and a color temperature of the second LED, and simultaneously lights the first and second LEDs at the adjusted light amount ratio.

9. The strobe device according to claim 8, wherein the color temperature of the first LED is a light bulb color temperature, and the color temperature of the second LED is a daylight color temperature.

10. A method of controlling a strobe device for use with an external camera, including a flashlight emission section, and an assist continuous light section which emits an assist continuous light using first and second LEDs which emit lights different in color temperature from each other, respectively, comprising:

adjusting a color temperature of the assist continuous light by either lighting one of the first and second LEDs or simultaneously lighting the first and second LEDs at an adjusted light amount ratio between the two LEDs;

determining whether a lighting mode of the assist continuous light section is a still image pre-check mode or a moving image mode;

acquiring a color temperature of an ambient light; and determining, in a case where it is determined that the lighting mode is the still image pre-check mode, whether or not the color temperature is higher than a threshold value, wherein said adjusting includes adjusting, in a case where it is determined by the second determination unit that the color temperature is higher than the threshold value, the light amount ratio such that a light amount of the first LED is larger than a light amount of the second LED, and adjusting, in a case where it is determined that the color temperature is not higher than the threshold value, the light amount ratio such that the light amount of the second LED is larger than the light amount of the first LED.

11. A method of controlling a strobe device for use with an external camera, including a flashlight emission section, and an assist continuous light section which emits an assist continuous light using first and second LEDs which emit lights different in color temperature from each other, respectively, comprising:

adjusting a color temperature of the assist continuous light by either lighting one of the first and second LEDs or simultaneously lighting the first and second LEDs at an adjusted light amount ratio between the two LEDs;

determining whether a lighting mode of the assist continuous light section is a still image pre-check mode or a moving image mode; and acquiring a color temperature of an ambient light, wherein said adjusting includes lighting the first LED, in a case where it is determined that the lighting mode is the still image pre-check mode, and adjusting, in a case where it is determined that the lighting mode is the moving image mode, the light amount ratio such that the color temperature of the assist continuous light becomes a predetermined color temperature within a range between a color temperature of the first LED and a color temperature of the second LED, and simultaneously lighting the first and second LEDs at the adjusted light amount ratio.

* * * * *